United States Patent [19]

Nistri et al.

[11] Patent Number: 4,650,409

[45] Date of Patent: Mar. 17, 1987

[54] APPARATUS FOR UNIFORMLY DISTRIBUTING A DISINTEGRATED FIBROUS MATERIAL ON A FIBER LAYER FORMING SURFACE IN PLANTS FOR THE DRY FORMING OF PAPER

[75] Inventors: Ugo Nistri, Genova; Romano Baroffio, Tradate; Giuseppe Ghisu, Genova; Enzo Chiellini, Genova; Giorgio Padula, Genova; Giorgio Fonzi, Genova, all of Italy

[73] Assignee: Mira Lanza S.p.A., Genova, Italy

[21] Appl. No.: 722,369

[22] Filed: Apr. 12, 1985

[30] Foreign Application Priority Data

Apr. 27, 1984 [IT] Italy ..... 12501 A/84
Jan. 8, 1985 [IT] Italy ..... 12402 A/85

[51] Int. Cl.[4] ..... D04H 1/00

[52] U.S. Cl. ..... 425/82.1; 19/304; 19/305; 156/62.4; 209/388; 425/83.1; 425/401; 425/DIG. 60

[58] Field of Search ..... 425/82.1, 83, 80.1, 425/83.1, DIG. 60; 156/62.4; 19/304, 305; 209/388

[56] References Cited

U.S. PATENT DOCUMENTS

| | | | |
|---|---|---|---|
| 2,269,085 | 1/1942 | Morgan | 19/305 |
| 2,841,154 | 7/1958 | Dearsley | 19/304 |
| 4,112,549 | 9/1978 | Min et al. | 19/304 |
| 4,144,619 | 3/1979 | White et al. | 19/304 |
| 4,287,064 | 9/1981 | Ando et al. | 209/388 |

FOREIGN PATENT DOCUMENTS

| | | | |
|---|---|---|---|
| 422226 | 1/1935 | United Kingdom | 19/304 |

*Primary Examiner*—Willard E. Hoag
*Attorney, Agent, or Firm*—Spencer & Frank

[57] ABSTRACT

The formation head comprises a casing of substantially rectangular configuration in plan view provided with a perforated flat bottom-screen or sieve, and with a top wall having a number of openings communicating with the atmosphere. Opening into said casing is a conduit for feeding a flow of air-fluidized disintegrated fibers. A plurality of spaced parallel, horizontal rollers are rotatably mounted close to the perforated bottom of the said head structure. The said rollers are supported so as to be translated parallely to the bottom of the said structure. The said rollers are each provided with a plurality of peripheral radial needles. At a short distance from the bottom of the casing, parallely thereto, a moving web is mounted, cooperating with an underlying vacuum chamber onto which the screened fibers are deposited in a thin layer (S).

11 Claims, 9 Drawing Figures

APPARATUS FOR UNIFORMLY DISTRIBUTING A DISINTEGRATED FIBROUS MATERIAL ON A FIBER LAYER FORMING SURFACE IN PLANTS FOR THE DRY FORMING OF PAPER

BACKGROUND OF THE INVENTION

This invention relates to a method for the dry-forming of paper, of the kind in which cellulose fibers suspended in a stream of air are deposited onto an air-pervious web under the action of vacuum, thus forming a layer of fibers; the thus formed layer of fibers being then suitably pressed and compacted by means also of a suitable adhesive binder.

More particularly, this invention relates to an apparatus or head for depositing the fibers onto said web for the formation of the layer of fibers.

Some types of heads for depositing the fibers onto a formation web are known. Thus, for example, in the U.S. Pat. No. 3,581,706 filed on Nov. 13, 1969 and granted on June 1, 1971 to Mr. Karl Kristian Kobs Kroyer there is shown and described a formation head of the type disclosed above, comprising a cylindrical housing provided with a bottom flat perforated wall, with an inlet opening for a stream of air having fibers suspended therein, and provided in the interior thereof with a stirrer comprising one or more rotating stirring blades suspended at a short distance from said bottom wall, so mounted as to perform—together with the rotary motion about their axis—a circular translatory movement around the axis of the formation head.

One of the disadvantages of this formation head resides in the fact that due to the movement of the stirrers parallelly to the bottom wall, said bottom wall is liable to become clogged. Moreover, the planetary movement of the stirrers implies the arrangement, in the interior of the head, of very delicate drive members liable to be damaged or broken.

The European Patent Application No. 812000586 filed on Jan. 16, 1981 in the name of Scanweb I/S discloses a formation head comprising two cylindrical parallel perforated chambers, each provided in the interior thereof with a cylinder having radial needles thereon and tangent to one of the directrices of said chambers. Each chamber rotates around its axis, and the cylinder associated therewith rotates in the opposite direction around its axis. The fiber-entraining stream of air is fed into the interior of said cylindrical chambers, and the fibers outflowing from said cylindrical chambers are deposited onto the underlying formation web.

This formation head is relatively complicated and each head requires at least two distributing chambers and, nevertheless, the distribution onto the underlying cloth is scarcely uniform.

The U.S. Pat. No. 4,157,724 filed on Dec. 19, 1977 and granted on June 12, 1979 to Torsten B. Persson discloses a formation head substantially comprising a V-shaped reticulated bottom extending transversely to the formation web. Mounted within said container are stirrers for stirring the fibers being fed into said container so as to hurl them against said reticulated bottom and move them therealong to pass through the network thereof and deposit them onto the formation cloth. According to this formation head, said reticulated bottom extends laterally upwards to permit said stirrers to operate as well at the periphery of the network. However, this creates problems of uniform distribution. Moreover, due to the inherent mode of the operation of this head, the fibers are separated from the fiber-entraining stream of air before being fed into the head.

SUMMARY OF THE INVENTION

This invention aims to overcome the disadvantages of the heretofore known formation heads, by providing a new formation head in high-productivity installations for the dry-production of paper, said new head ensuring the deposition of a more uniform and homogeneous layer than those heretofore obtainable with any conventional formation head.

According to a feature of the invention, this object is achieved by mounting within the formation head, close to the perforated bottom wall thereof, a set of needle-equipped rollers rotatably supported around their axes and movable parallelly to the bottom of the formation head.

Advantageously, said rotatable rollers are arranged transversely to the direction of advance of the underlying fiber-carrying web and are rotated by one or more motors while translated parallelly to the bottom of the head.

By virtue of the arrangement described above, the following advantages are obtained:

(a) The rotary-translatory movement of the needle-equipped rollers located above the perforated bottom of the formation head ensures a better casual distribution of the fibers, thus improving their spatial distribution. Such a distribution enables the production of paper having a higher specific volume permitting to improve the bond between fibers and resin and enables the production of paper having geater softness and larger thickness, and therefore higher absorption capacity.

(b) The continuous cleaning of the planar perforated bottom or sieve ensures, in comparison with a head having the same area and vacuum, a greater specific outflowing capacity (expressed in $Kg/m^2$) of the heterogeneous mixture air/fibers and, therefore, a greater productivity at a parity of the other parameters (such as speed of advance of the formation web, flowrate of air, area of the formation head, etc.).

(c) The continuous cleaning of the sieve ensures a better distribution of fibers on the formation web either in the longitudinal and in the transverse directions, thus avoiding the formation of side fringes having different thickness and substance, which are found in the paper produced by the formation heads described previously, and which must be cut off, with resulting loss of productivity.

(d) The absence of recirculation permits to preserve the quality of the fibers (under the dimensional aspect) which will not be submitted to any further grinding in the mill.

According to a first embodiment of the invention, the said needle-equipped rollers or cylinders are rotatably supported around their axis, above the bottom screen of the formation head, and are provided with an alternative to and fro movement in a plane parallel to the plane of said screen.

It has been however discovered that with the above mentioned arrangement there is a certain tendency to the accumulation of cellulosic aggregates between the needle-equiped rollers. It has been also noted that the said aggregates tends to increase in dimensions and in quantity during the time by effect of the alternative movement of the needle-equiped rollers, which facilitates a compaction between said agglomerates and the cellulosic fibers.

According to a further feature of the invention, it has been noted that it is possible to obviate to the above drawbacks by conferring to the needle-equipped rollers an unidirectional roto-translative motion.

According to one embodiment of the invention, the above is obtained by supporting the needle-equipped rollers between a pair of endless chains which are driven by suitable motor-operated chain wheels.

It has been further noted a certain tendency of the ground cellulose to be compressed against the screening net, with following formation of agglomerates and with the consequent forced passage of cellulosic agglomerates through the screening net, with the result that the quality of the final product is negatively influenced.

According to a still further embodiment of the invention, the above described drawback is obviated by associating with each needle-equipped roller a fixed capping or shielding element which screens at least that portion of the surface of the roller which is disposed upstream of the zone of contact between the needle-equipped cylinder and the screening net, in the direction of rotation of the said roller.

Thanks to the presence of the said shielding element, also the distorsion of the air flow and of the entrained ground cellulose is obviated, thus reducing the ventilation effect caused by the rotation of the needle-equipped rollers.

BRIEF DESCRIPTION OF THE DRAWINGS

Further characteristics and advantages of the present invention will become evident form the following description of some preferred embodiments of same, made with reference to the accompanying drawings, in which.

DESCRIPTION OF THE PREFERRED EMBODIMENTS

Figure 1:
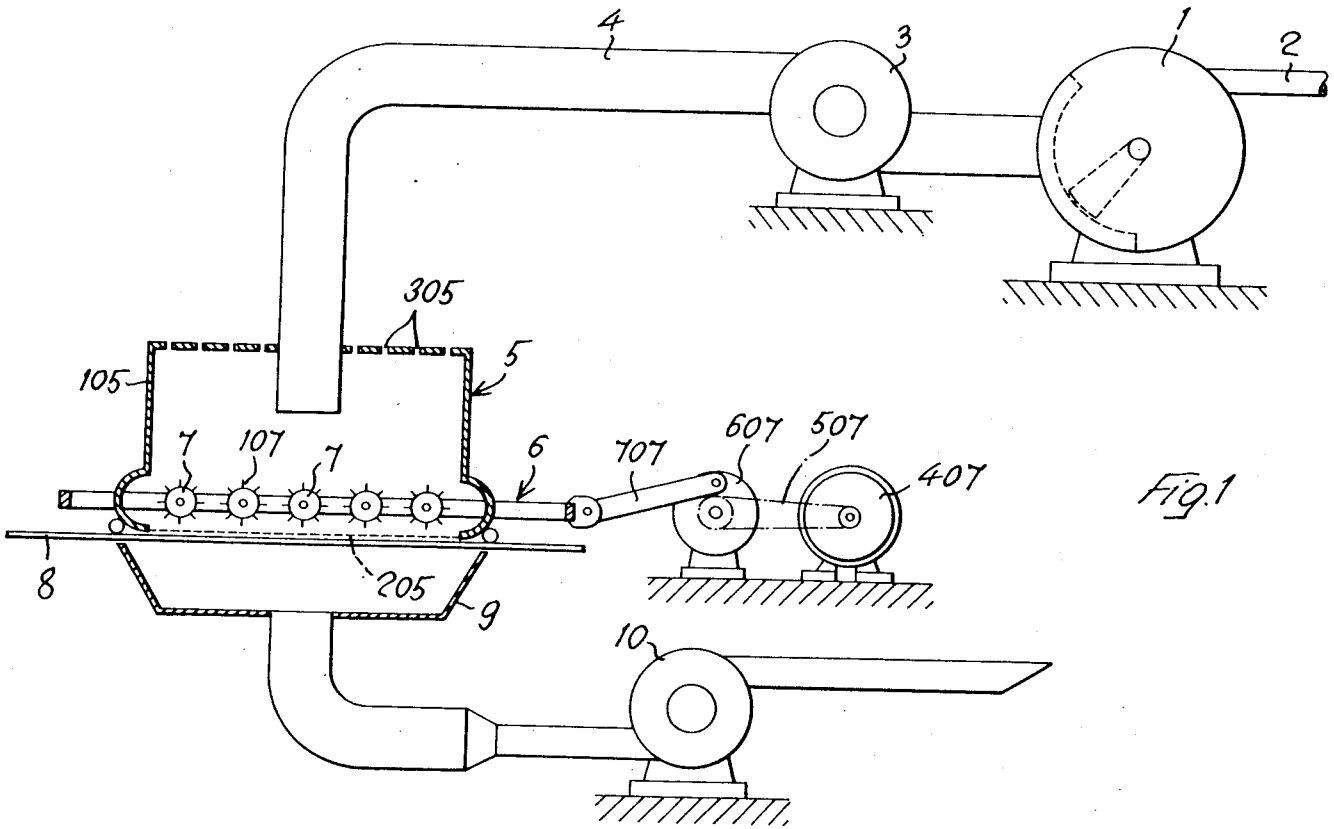
FIG. 1 is a diagrammatic elevational and partly sectional view of a plant for the dry-production of paper according to the invention.
Figure 2:
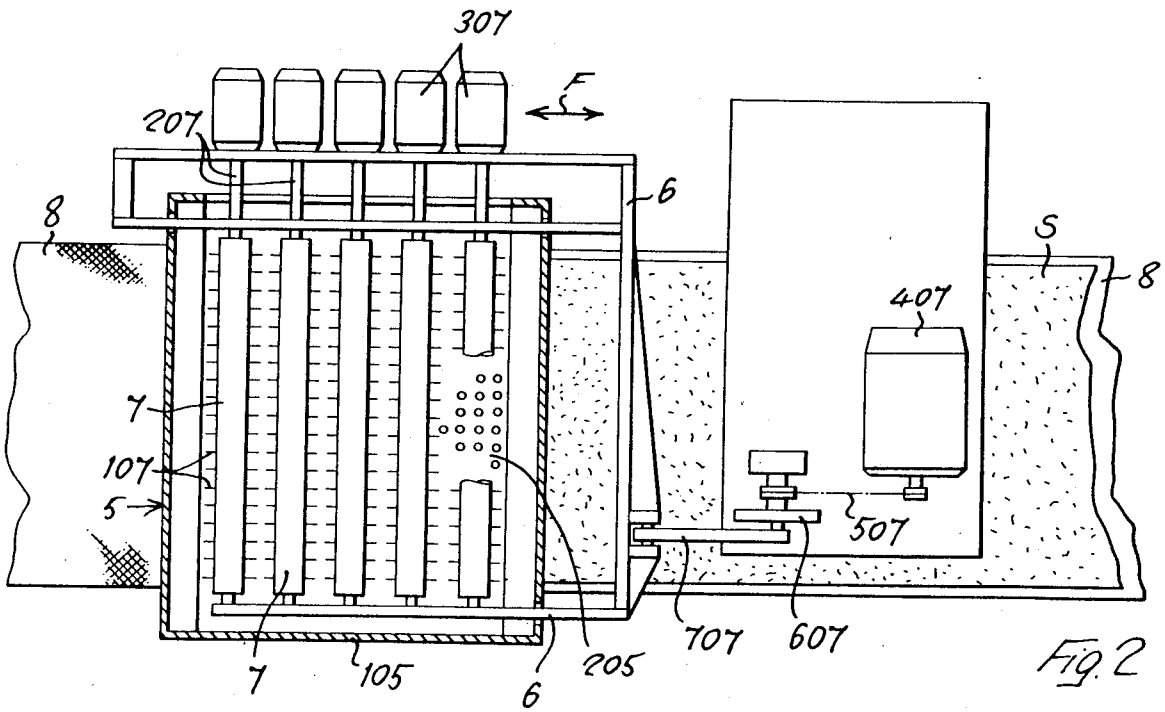
FIG. 2 is a plan and partly sectional view, on a larger scale, of the formation head of the plant shown in FIG. 1.

With reference to the drawings, and particularly with reference to FIGS. 1 and 2 thereof, numeral 1 is a mill, such as a hammer mill, receiving the cellulosic material from 2, said cellulosic material being disgregated into fibers which are entrained out of the mill suspended in a stream of air created by an exhauster 3, and such a suspension of fibers and air is fed through the conduit 4 into the formation head 5.

The formation head 5 substantially comprises a casing 105 of rectangular configuration in plan view, closed at the bottom by a perforated screen 205 and having a number of openings 305 in the top wall for communication with the atmosphere.

The numeral 6 indicates generally a frame which is mounted so as to slide on a horizontal plane parallel to the bottom 205 of the head 5. This frame extends into the interior of the head 5, and a set of mutually parallel rollers 7 provided with radial needles 107 are rotatably mounted on said frame. The shafts 207 of the rollers 7 are actuated by electric motors 307. An electric motor 407, through a belt 507, a crank 607 and a connecting rod 707, reciprocates said frame 6 in the direction of the arrow F of FIG. 2.

The numeral 8 indicates the web for the dry-formation of a sheet of paper S. Said web 8 is formed by a pervious endless web which is translated below the head 5 at a short distance from the bottom 205 of said head. Located below the web 8, opposite the head 5, is a casing 9 connected to a vacuum source 10. In a manner known per se, the fibers passed through the perforated bottom 205 of the casing 5 will be deposited in the form of a layer S onto the web 8 due to the action of the vacuum in the casing 9.

The operation of the plant described above is apparent. Due to the rotary-translatory movement of the needle-equipped rollers 7 located above the bottom sieve 205 of the head 5, an optimum casual distribution, and thus a better spatial distribution, of the fibers is obtained. This distribution enables the production of paper S having a higher specific volume, greater softness, larger thickness and, therefore, higher absorption capacity.

By virtue of the continuous cleaning of the flat bottom sieve 205, it will be possible to obtain, in comparison with a formation head having the same area and vacuum, a greater specific outflowing capacity of the heterogeneous mixture of air and fibers, thus achieving a greater productivity at a parity of the other parameters (speed of advance of the web 8, flowrate of air, surface 205 of the formation head) which was not possible heretofore with the conventional installations.

Finally, the continuous cleaning of the sieve ensures a better distribution of the fibers on the formation web 8 either in the longitudinal and transverse directions, thus obtaining a final product S which is highly homogeneous, free from side fringes having different thickness and substance and which must be cut off with resulting loss of productivity.

Figure 3:
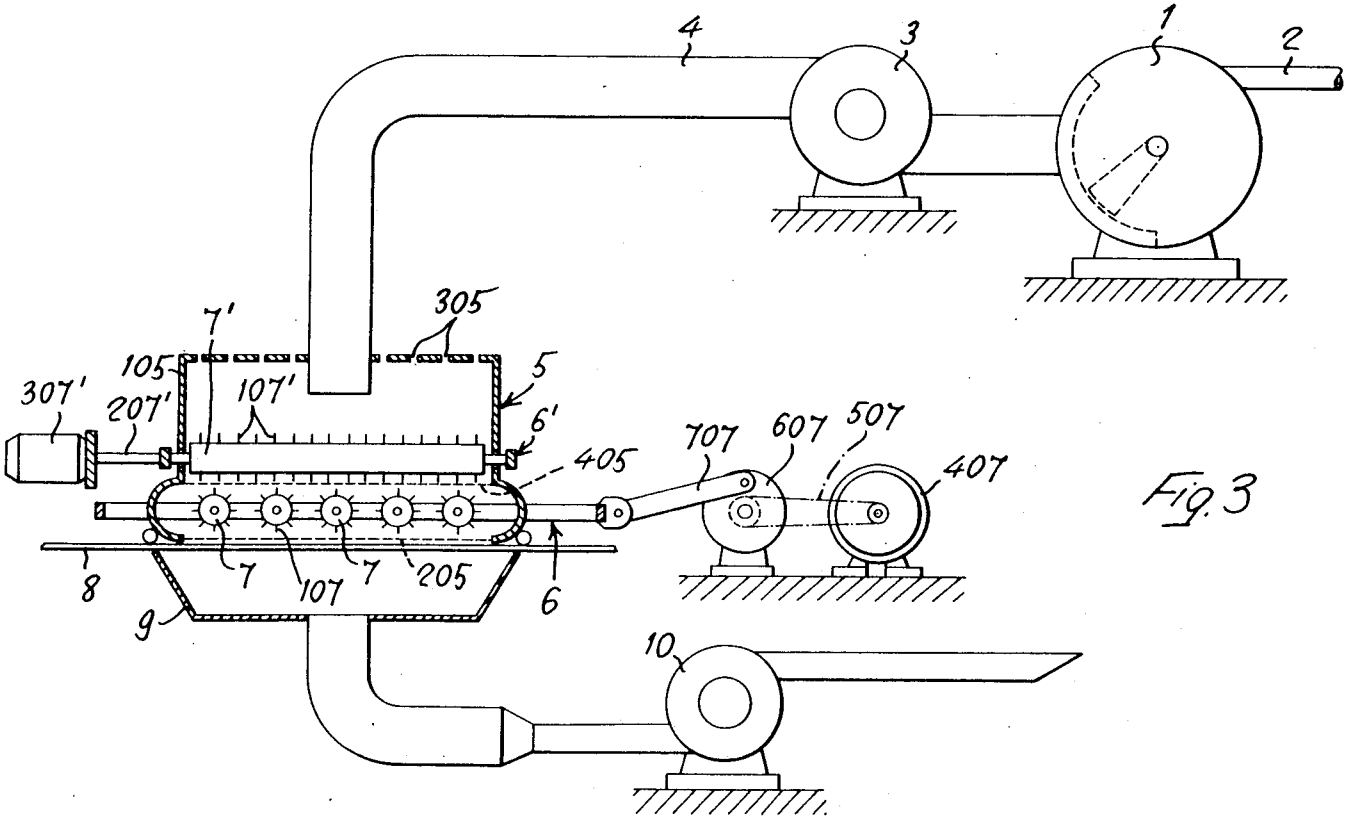
FIG. 3 is a diagrammatic view similar to FIG. 1, of a modified embodiment of a plant for the dry-production of paper according to the invention.
Figure 4:
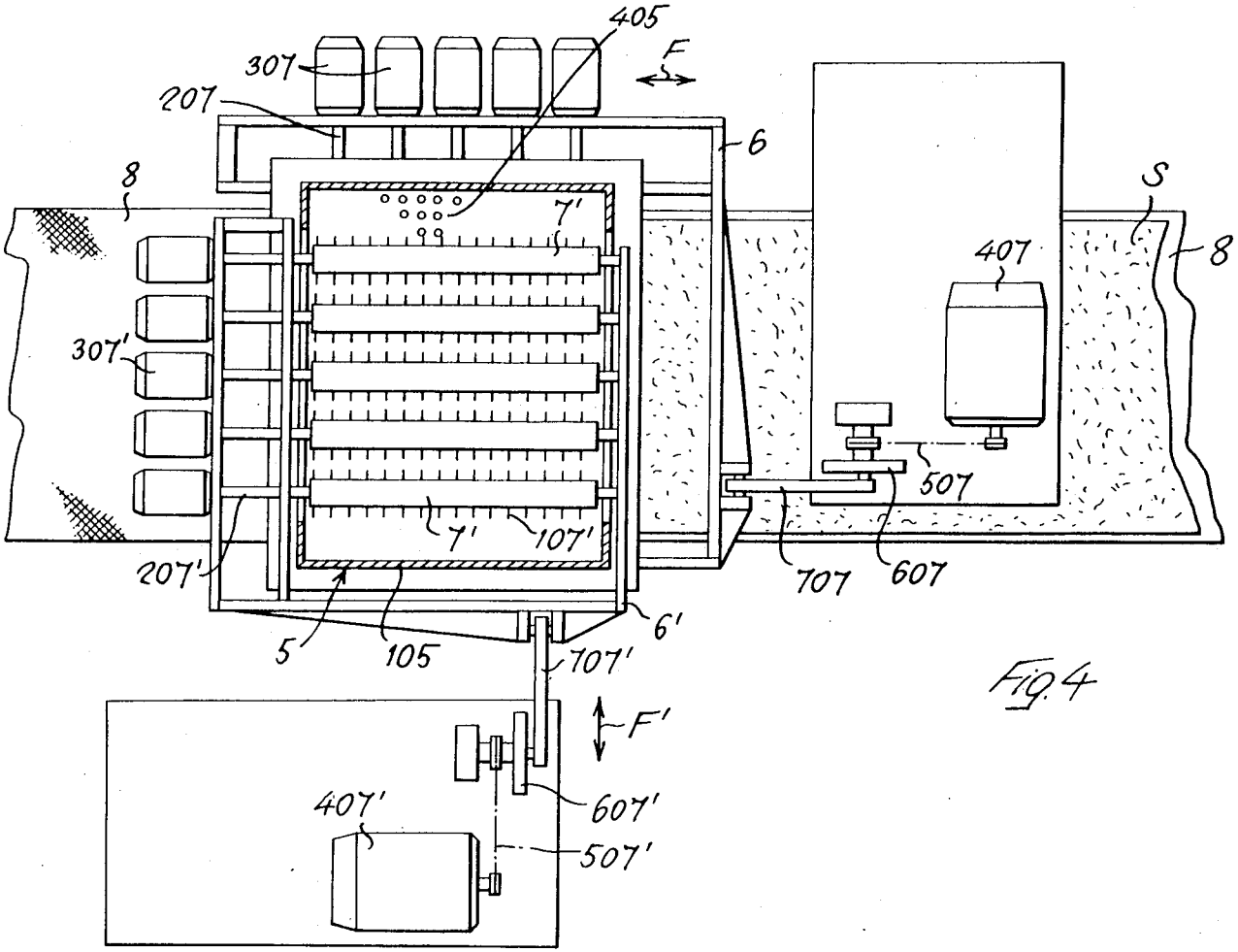
FIG. 4 is a plan and partly sectional view of the formation head of the modified embodiment shown in FIG. 3.

FIGS. 3 and 4 show a modified embodiment of the plant according to the invention. In the illustrated embodiment, the same reference numerals have been used to indicate parts which are equal or corresponding to those shown in FIGS. 1 and 2.

As shown, this embodiment differs from the preceding embodiment because within the head 5, above the set of rollers 7, there are mounted a second set of rollers 7' whose axes are perpendicular to the axes of the rollers 7, and which are rotatably supported by a frame 6' reciprocatingly movable in a plane parallel to the plane of the frame 6, in a direction which is perpendicular to that of the frame 6 (direction of the arrow F). The frame 6′ is reciprocated by a motor 407′ through the drive mechanism 507′, 607′, 707′. The rollers 7′ are actuated by the motors 307′ through the shafts 207′ of the rollers 7′.

Arranged below the rollers 7′ is an intermediate sieve 405, similar to the sieve 205. The operation of the embodiment just described and illustrated is apparent. The fibers fed from the conduit 4 are subjected to a first screening and a first grading at the sieve 405 by the action of the rollers 7′, and are then fed to the underlying sieve 205, which co-operates with the rollers 5, and are then fed onto the web 8 for the formation of a sheet S.

Of course, the layer of fibers S, after a suitable compaction, is submitted, in a manner known per se, to a binding step by means of a suitable adhesive binder, and a compaction step by means of calendering cylinders having either a smooth or an embossed surface (not shown).

Figure 5:
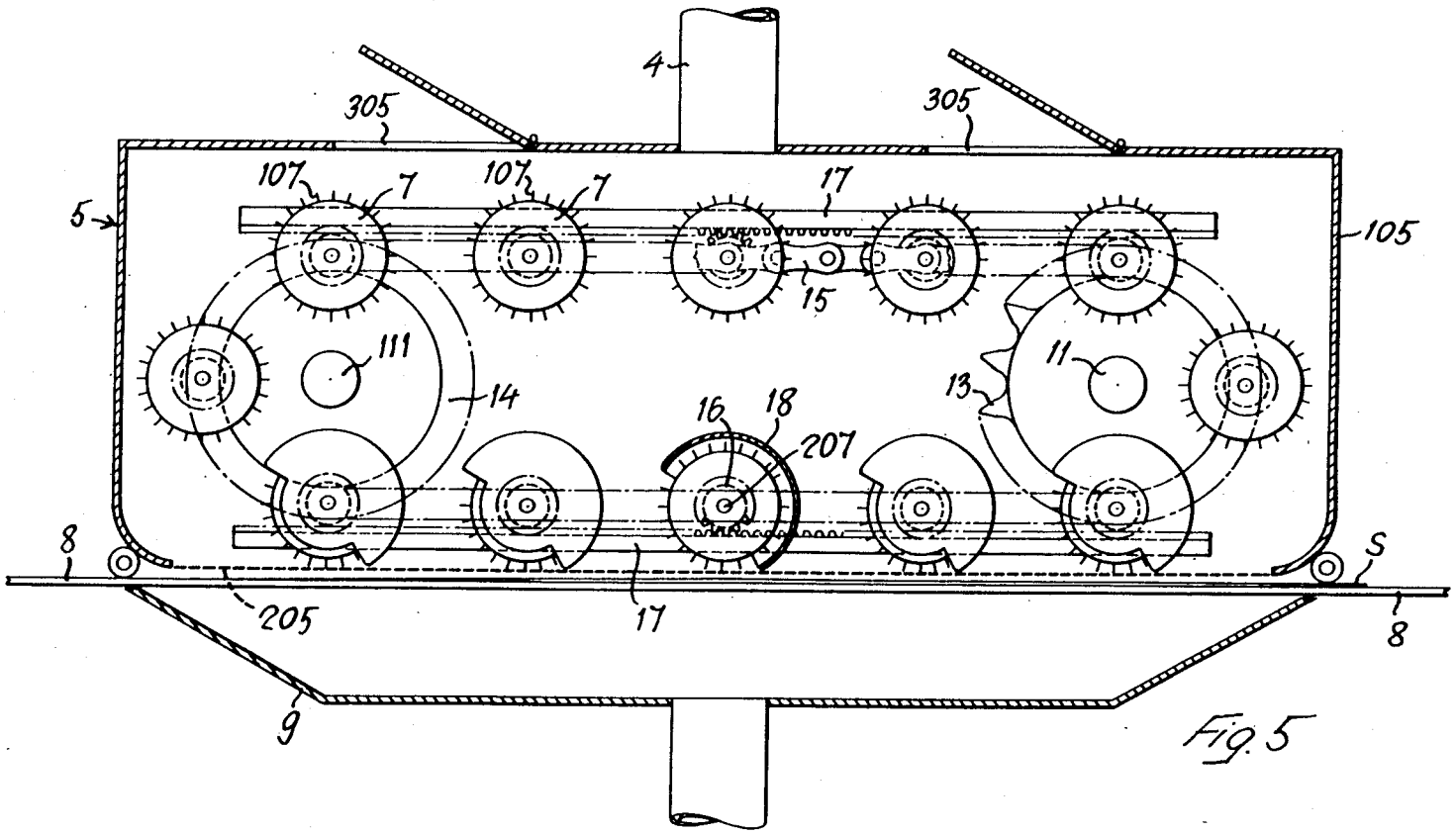
FIG. 5 is a diagrammatic elevational and partly sectioned view, of a formation head according to another embodiment of the invention.
Figure 6:
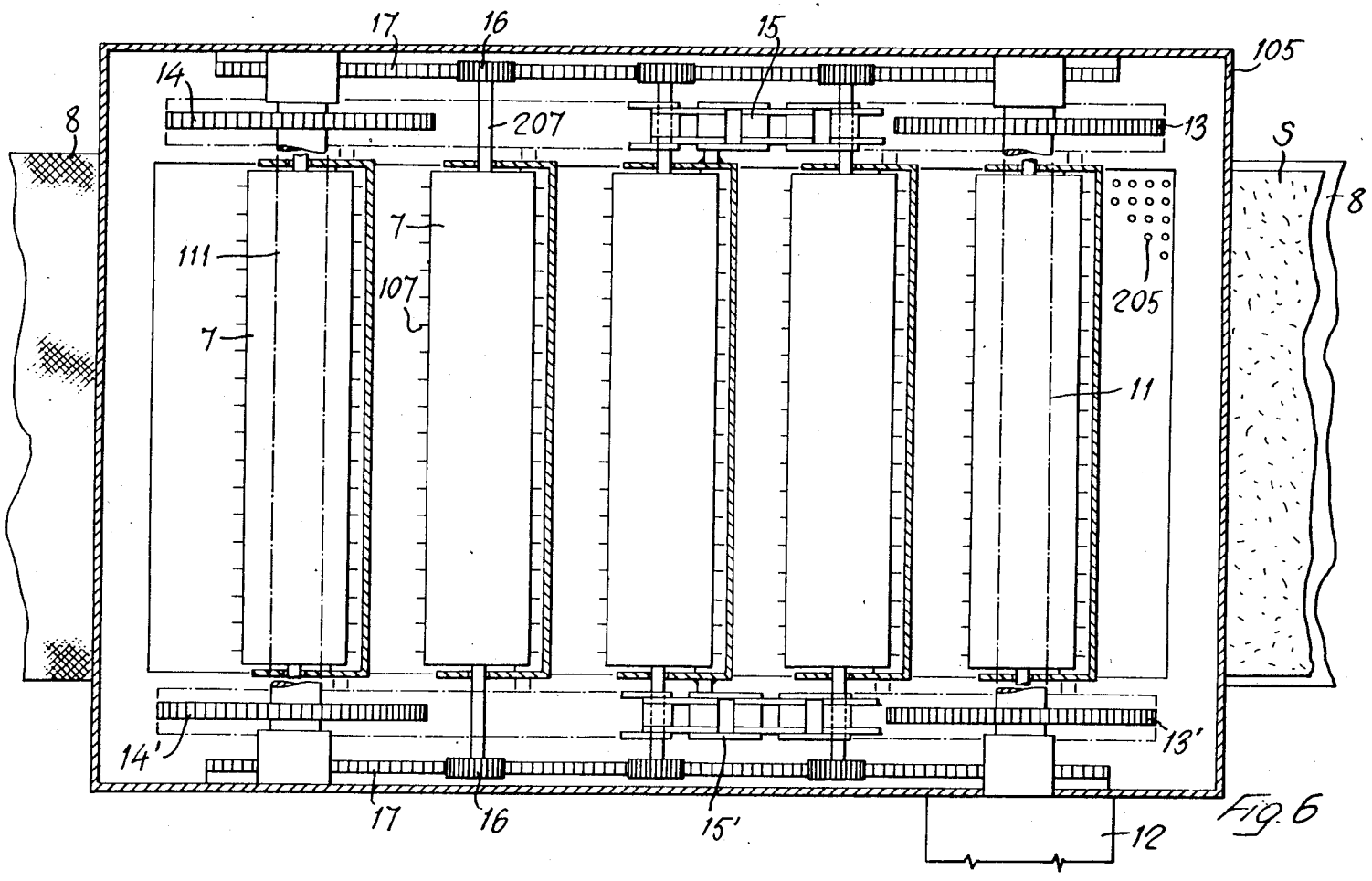
FIG. 6 is a top plan view, partly sectioned, of the formation head according to FIG. 5.

With reference to the embodiment of the invention shown in FIGS. 5 and 6 of the drawings, 5 is the distributing head, comprising the casing 105 of rectangular configuration in plan view, closed at the bottom by the perforated screen 205, and provided with a number of openings 305 in its top wall, for communication with the atmosphere. With numeral 4 the conduit is shown for feeding a flow of air-fluidized disintegrated cellulosic fibers inside of the casing 5, whilst with numeral 8 the web is shown, onto which the screened fibers are deposited in a thin layer, for the formation of the dry paper sheet S. With 9 a suction casing is denoted, which is connected to a suitable vacuum surce (not shown).

With 11 and 111 two shafts are shown, extending transversally across the casing 105, and suitably journalled at their ends. The shaft 11 is connected to a suitable driving motor 12, whilst the shaft 111 is idle supported. At both ends of the shafts 11 and 111 the chain wheels 13, 13′, 14 and 14′ are mounted. Around the said chain wheels the chains 15, 15′ are guided. To the said chains 15, 15′ the shafts 207 of the needle-equipped rollers 7 are idle suspended. To the ends of said shafts 207 the pinions 16 are secured, which pinions may be brought into mesh with the rack bars 17, which are secured to the casing 105 both parallelly to the bottom 205 and parallelly to the upper wall of said casing.

Figure 8:
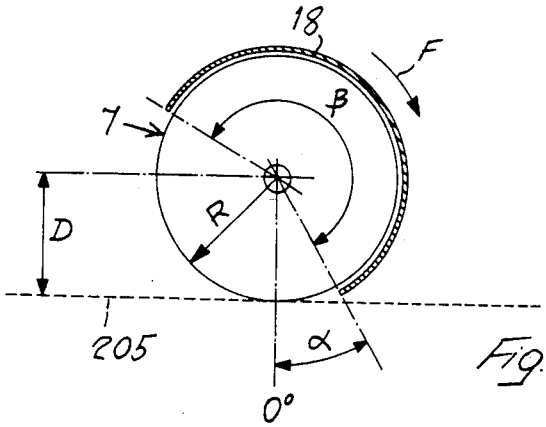
FIG. 8 shows the same cylinder of FIG. 7, provided with the capping or shielding element according to a further embodiment of the invention.

Each neddle-equipped roller, or at least some of them, are partially covered by a shielding or capping element 18, best shown in FIG. 8, for the purposes which will be described later.

The said shielding element 18 extends peripherally around each roller 7 by an angle $\beta$ which is equal to $270°-\alpha$, $\alpha$ being an angle comprised between 0° and 90°, extending from the tangency point of the roller 7 with the bottom 205 in a direction opposite to the direction F of rotation of the roller 7, R being the radius of the needle-equipped roller.

The said shielding element 18, which covers also the heads of the roller 7, forms an adjustable capping element preveting the accumulation of agglomerates in the tangency zone between the rollers 7 and the perforated screen 205, with following extrusion of said agglomerates through the perforations of the screen.

Figure 7:
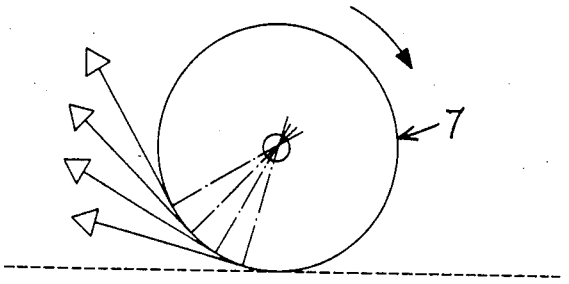
FIG. 7 is a diagrammatic end view of a needle-equipped roller used in the formation heads according to the invention.

The said shielding element prevents furthermore the distorsion of the air flow due to the quick rotation of the rollers 7, as shown diagrammatically in FIG. 7, which would entrain a non-homogeneous distribution of the fibers on the underlying formation web.

The operation of the described device will be evident. The rollers 7 are translated by the driving chains 15, 15′. During the motion of the rollers 7, the pinions 16 are brought into mesh with the rack bars 17, thus imparting to said rollers 7 a rotational movement about their shafts 207.

Figure 9:
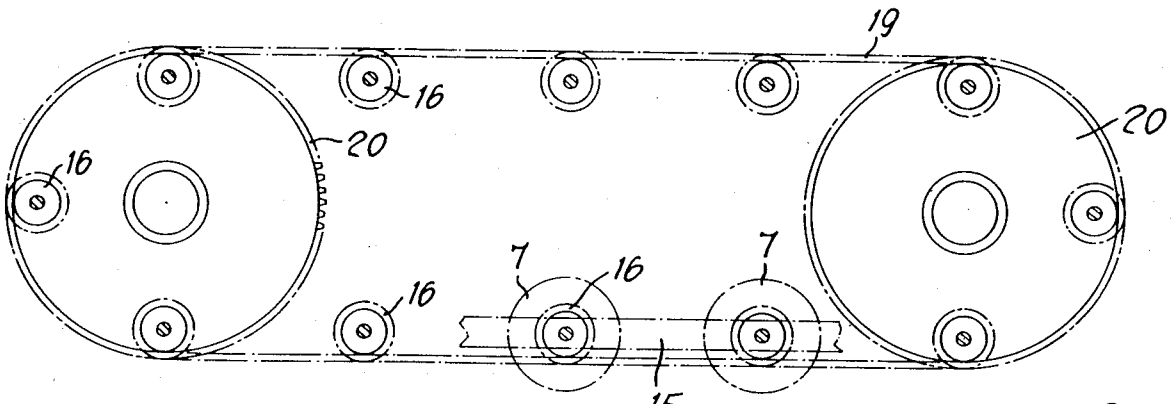
FIG. 9 shows a particular of a still further embodiment of a driving device for the needle-equipped rollers used in the formation head shown in FIG. 5.

In FIG. 9 a still further embodiment of the invention is shown, according to which the rack bars have been substituted by the toothed belts 19, which are driven by the wheels 20, 20′, the wheel 20 being driven by a suitable motor (not shown).

Of course, the endless belts 19 may also be formed by trapezoidal belts, in which instance the pinions 16 will be substituted by pulleys.

Of course, the present invention is not limited to the embodiments shown and described, which are intended to be only non limiting examples, and it is to be understood that changes may be made to the described embodiments without departing from the spirit of the invention, as claimed in the appended claims.

What is claimed is:

1. A plant for the dry production of paper, comprising in combination means for disintegrating a cellulosic material, means for suspending the thus-obtained cellulosic fibers in a stream of air and for feeding said fiber-entraining stream of air to a formation head; an air-pervious web for the dry-formation of a paper layer or sheet movable below said formation head; and suction or vacuum means located below said web, characterized in that said formation head is closed at the bottom by a perforated screen or sieve mounted above said web, a set of parallel rollers provided with radially-projecting needles or points being supported above said sieve so as to be rotatable around their axes and slidable in a direction parallel to said sieve, wherein said rollers are provided with a shielding element extending from a zone near the tangency point of said rollers with the underlying bottom screen of the formation head around said rollers by an angle of $270°-\alpha$, $\alpha$ being an angle comprised between 0° and 90°.

2. A plant for the dry production of paper, comprising in combination means for disintegrating a cellulosic material, means for suspending the thus-obtained cellulosic fibers in a stream of air and for feeding said fiber-entraining stream of air to a formation head; an air-pervious web for the dry-formation of a paper layer or sheet movable below said formation head; and suction or vacuum means located below said web, characterized in that said formation head is closed at the bottom by a perforated screen or sieve mounted above said web, a set of parallel rollers provided with radially-projecting needles or points being supported above said sieve so as to be rotatable around their axes and to be reciprocatable in a direction parallel to said sieve and perpendicular to their longitudinal axes of rotation, the reciprocation stroke of said rollers being at least a half of the spacing between one roller and the next successive roller.

3. The plant according to claim 2, in which the said rollers are rotatably driven around their longitudinal axis at equal or different speeds, in the same or in opposite directions.

4. The plant according to claim 2, in which said rollers are provided on their mantle with radially projecting needles, points or metallic brushes.

5. The plant according to claim 2, characterized by the fact that the said formation head is further provided with a second set of needle-equipped rollers slidably and rotatably supported in an intermediate portion of said head, above said first set of needle-equipped rollers, and cooperating with a second intermediate screen mounted within said formation head.

6. A plant for the dry production of paper, comprising in combination means for disintegrating a cellulosic material, means for suspending the thus-obtained cellulosic fibers in a stream of air and for feeding said fiber-entraining stream of air to a formation head; an air-pervious web for the dry-formation of a paper layer or sheet movable below said formation head; and suction or vacuum means located below said web, characterized in that said formation head is closed at the bottom by a perforated screen or sieve mounted above said web, a set of parallel rollers provided with radially-projecting needles or points being supported above said sieve so as to be rotatable around their axes, said rollers having axles mounted on support means for moving said axles in one direction only that is parallel to said screen when said rollers are adjacent said screen.

7. The plant according to claim 6, in which said rollers are suspended on endless supporting chains or belts, said chains or belts being provided with one section extending parallel to the said bottom screen of the formation head.

8. The plant according to claim 7, in which the said rollers are entrained into rotation about their axes through pinions mounted on the axes of the said rollers, meshing with fixed rack bars secured to the said formation head.

9. The plant according to claim 7, in which the said rollers are entrained into rotation by means of an endless chain or belt, meshing with corresponding pinions mounted on the shafts of said rollers.

10. The plant according to claim 6, in which the said rollers are rotatably driven around their longitudinal axis at equal or different speeds, in the same or in opposite directions.

11. The plant according to claim 6, in which said rollers are provided on their mantle with radially projecting needles, points or metallic brushes.

* * * * *